US006155445A

United States Patent [19]

Weder et al.

[11] Patent Number: 6,155,445

[45] **Date of Patent: *Dec. 5, 2000**

[54] BASKET WRAPPING MATERIAL HAVING BONDING MATERIAL THEREON AND METHOD

[75] Inventors: Donald E. Weder; Kenneth T. Barker, both of Highland, Ill.

[73] Assignee: Southpac Trust International, Inc.

[ * ] Notice: This patent issued on a continued prosecution application filed under 37 CFR 1.53(d), and is subject to the twenty year patent term provisions of 35 U.S.C. 154(a)(2).

[21] Appl. No.: 08/588,961

[22] Filed: Jan. 19, 1996

Related U.S. Application Data

[63] Continuation-in-part of application No. 07/958,666, Oct. 8, 1992, abandoned.

[51] Int. Cl.[7] ..... B65B 11/00

[52] U.S. Cl. ..... 220/9.4; 220/62.14; 220/62.22; 220/694

[58] Field of Search ..... 220/401, 403, 220/460, 470, 485, 9.4, 62.14, 62.22, 694

[56] References Cited

U.S. PATENT DOCUMENTS

| | | | |
|---|---|---|---|
| 732,889 | 7/1903 | Paver . | |
| 920,313 | 5/1909 | Franklin . | |
| 1,102,499 | 7/1914 | Haist . | |
| 1,525,015 | 2/1925 | Weeks . | |
| 2,239,398 | 4/1941 | Palmer | 229/14 |
| 2,260,230 | 10/1941 | Olson | 206/44 |
| 2,371,985 | 3/1945 | Freiberg | 206/46 |
| 2,458,246 | 1/1949 | Brereton | 220/84 |
| 2,529,060 | 11/1950 | Trillich | 117/68.5 |
| 2,544,075 | 3/1951 | Ernst et al. | 150/49 |
| 2,573,770 | 11/1951 | Meadow | 150/28 |
| 2,846,060 | 8/1958 | Yount | 206/58 |
| 2,883,262 | 4/1959 | Borin | 21/56 |
| 3,022,605 | 2/1962 | Reynolds | 47/58 |
| 3,121,647 | 2/1964 | Harris et al. | 118/202 |
| 3,130,113 | 4/1964 | Silman | 161/97 |
| 4,333,267 | 6/1982 | Witte | 47/84 |
| 4,413,725 | 11/1983 | Bruno et al. | 206/45.3 |
| 4,546,875 | 10/1985 | Zweber | 206/82 |
| 4,733,521 | 3/1988 | Weder et al. | 53/580 |
| 4,765,464 | 8/1988 | Ristvedt | 206/82 |
| 5,111,638 | 5/1992 | Weder | 53/397 |

OTHER PUBLICATIONS

Gift Wraps Baskets & Bows, Norden, p. 94, 1995.

*Primary Examiner*—Steven Pollard
*Attorney, Agent, or Firm*—Dunlap, Codding & Rogers, P.C.

[57] ABSTRACT

A basket wrapping material forming a bow in a wrapping about an outer periphery of a basket. The basket wrapping material forms both a bow and a closure in the sheet of material about a basket. Methods of wrapping a basket with a basket wrapping material which forms both a bow and a closure.

19 Claims, 12 Drawing Sheets

BASKET WRAPPING MATERIAL HAVING BONDING MATERIAL THEREON AND METHOD

CROSS-REFERENCE TO RELATED APPLICATIONS

This application is a continuation-in-part of U.S. Ser. No. 07/958,666, filed Oct. 8, 1992 now abandoned, entitled BASKET WRAPPING MATERIAL HAVING AT LEAST A PORTION OF AN ADHESIVE AND/OR COHESIVE THEREON AND METHOD.

BACKGROUND OF THE INVENTION

1. Field of the Invention

This invention generally relates to basket wrapping materials and, more importantly, to basket wrapping materials having at least a portion of an adhesive and/or cohesive thereon, and methods of using same.

2. Background Art

Various methods of wrapping baskets have been provided over the years. None, however, have been provided which provide a sheet of material which simultaneously wraps a basket, provides a closure to said wrapping and provides a decorative bow at the top of the wrapping.

SUMMARY OF THE INVENTION

A need has been felt in the art to provide a basket wrapping material which simultaneously wraps a basket, provides a closure to the wrapping, and also provides a decorative bow, formed from the sheet of material, at the top of the present invention. The present invention provides a basket wrapping material which forms a bow in a wrapping wrapped about a basket. The present basket wrapping material comprises a sheet of material having an upper surface, a lower surface, and an outer periphery. The sheet of material is constructed of a flexible material. The sheet of material has a plurality of bonding materials disposed on at least one surface. The plurality of bonding materials are utilized to form both a bow and a closure in the sheet of material, when the sheet of material is wrapped about an outer periphery of a basket. When wrapped about a basket, the outer periphery of the sheet of material extends above a basket, thereby forming a wrapping. When one of the plurality of bonding materials is connected to another of the plurality of bonding materials adjacent thereto, a loop in the outer periphery of the sheet of material is created. Both a bow and a closure in the sheet of material is formed when each of the plurality of adjacent bonding materials is connected together, creating a plurality of loops in the outer periphery of the sheet of material. The plurality of loops form both a bow above the wrapping and a closure of the sheet of material about a basket.

The basket wrapping material may be made from polymer film, fabric, cloth, fiber, paper, burlap, cellulose, foil or combinations thereof. The basket wrapping material may be formed from a sheet of material having a thickness in a range of about 0.2 mils to about 10 mils. The basket wrapping material may also be formed from a sheet of material having a thickness in a range of about 0.5 mils to about 3.5 mils. The basket wrapping material may have a bonding material which comprises a plurality of adhesive spots which extend about the outer periphery of the sheet of material. The basket wrapping material may, alternatively, have a bonding material which comprises a plurality of cohesive spots which extend about the outer periphery of the sheet of material. The basket wrapping material comprises a sheet of material which may further comprise a bag, or, alternatively, a sleeve.

DESCRIPTION OF THE PREFERRED EMBODIMENTS

Embodiments of FIGS. 1–6

Figure 1:
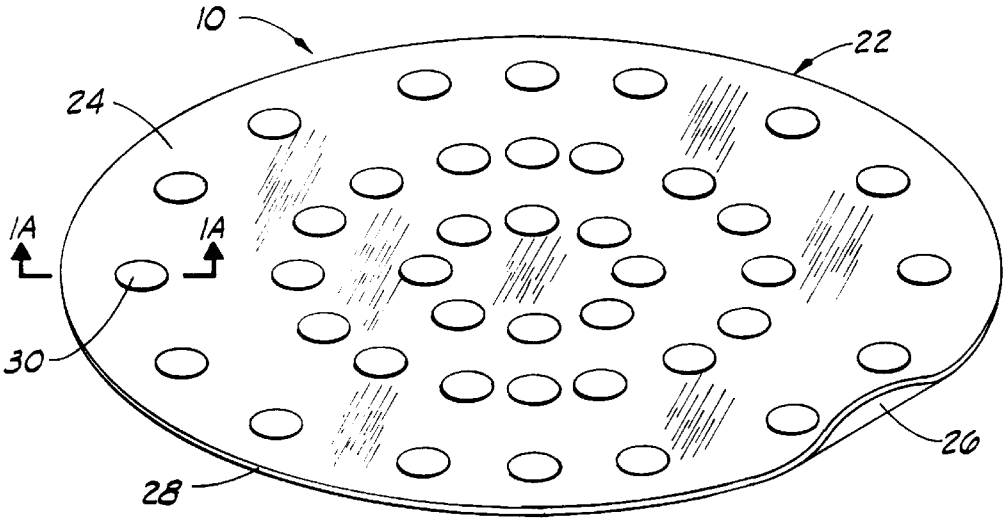
FIG. 1 is a perspective view of the basket wrapping material of the present invention.
Figure 2:
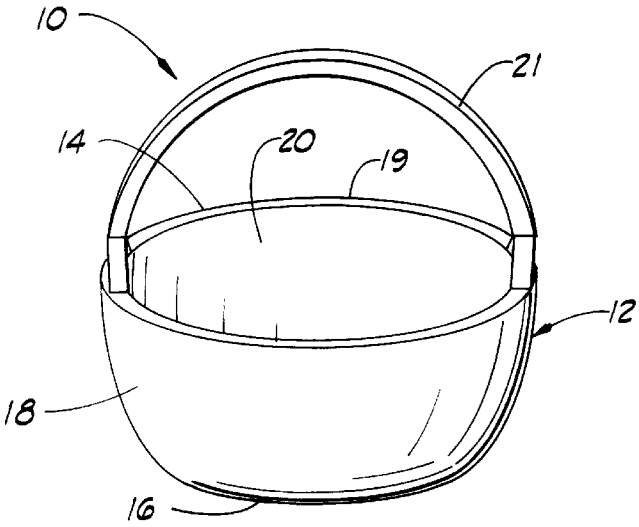
FIG. 2 is a perspective view of a basket used in the present invention.

Referring to FIGS. 1–6, designated generally by the reference numeral 10 is a basket wrapping material which is constructed in accordance with the present invention for wrapping at least a portion of a basket. The basket wrapping material 10 is used to wrap about the outer surface of the basket. One such basket is shown in FIG. 2, and is generally designated by the numeral 12. The basket 12 has an upper end 14, a lower end 16, and an outer surface 18. An opening 19 is formed in the basket 12, with a portion of the basket opening 19 intersecting the upper end 14 of the basket 12 forming an inner surface 20. The basket opening 19 is sized and shaped for receiving items (not shown). The items are retained in the basket opening 19 by the basket 12. The basket 12, in embodiments illustrated herein, has a handle 21 (FIGS. 2, 4–6) which attaches to the basket near the basket opening 19. It will be appreciated, however, that baskets 12 without handles may be utilized as described herein. Examples of baskets 12 which are used in accordance with the present invention include, but not by way of limitation, fruit baskets, Easter baskets, picnic baskets, flower baskets, and the like. It will be appreciated that other baskets not mentioned herein but known in the art may also be utilized in conjunction with the present invention.

Figure 1A:
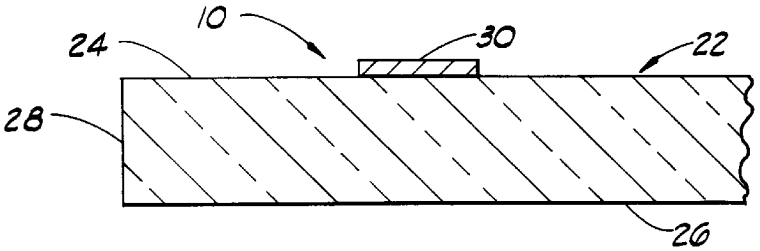
FIG. 1A is a cross-sectional partial view of FIG. 1 taken substantially along the lines 1A—1A of FIG. 1.

Referring to FIGS. 1 and 1A, the basket wrapping material 10 comprises a sheet of material 22. The sheet of material has an upper surface 24, a lower surface 26, and an outer periphery 28.

In the embodiment shown in FIG. 1, the sheet of material 22 is round. It will be appreciated, however, that any shape or size of material 22 or any combination of sheets of material 22, may be used to wrap about the outer surface 18 of a basket 12 of any shape or size. For example, a round sheet 22 may be used to wrap a square basket 12, or vice versa. Moreover, when multiple sheets of material 22 are used in combination, the sheets of material 22 need not be uniform in size or shape. It will also be appreciated that the basket wrapping material 10 shown in all embodiments herein is substantially flat.

The basket wrapping material 10 may be made from a variety of materials. Examples of some basket wrapping materials used in accordance with the present invention are polymer films, fabric, cloth, fiber, paper, cellulose, (including cellophane), burlap, foil, or any combination thereof.

The term "polymer film" means a man-made polymer such as a polypropylene or a naturally occurring polymer such as cellophane. A polymer film is relatively strong and not as subject to tearing (substantially non-tearable), as might be the case with paper or foil.

Each sheet of material 22 may vary in color. Further, each sheet of material 22 may consist of designs which are printed, etched, and/or embossed; in addition, each sheet of material 22 may have various colorings, coatings, flockings and/or metallic finishes, or be characterized totally or partially by neon, pearlescent, translucent, transparent, iridescent, or the like characteristics. Each of the above-named characteristics may occur alone or in combination. Moreover, each surface of the sheet of material 22 may vary in the combination of such characteristics, that is, a surface of the sheet of material, or any portion thereof, may have any of the above-described features, and/or may be clear, tinted, opaque, translucent or tinted transparent.

The sheet of material 22 may be constructed of a single sheet of material or a plurality of sheets. Any thickness of the sheet of material 22 may be utilized in accordance with the present invention as long as the sheet of material may be disposed about the outer surface 18 of a basket 12 as described herein. Typically, the sheet of material 22 has a thickness in a range of about 0.2 mils to about 10 mils. In one embodiment, the sheet of material 22 is constructed from one sheet of polymer film having a thickness in a range from about 0.2 mils to about 3.5 mils.

Figure 3:
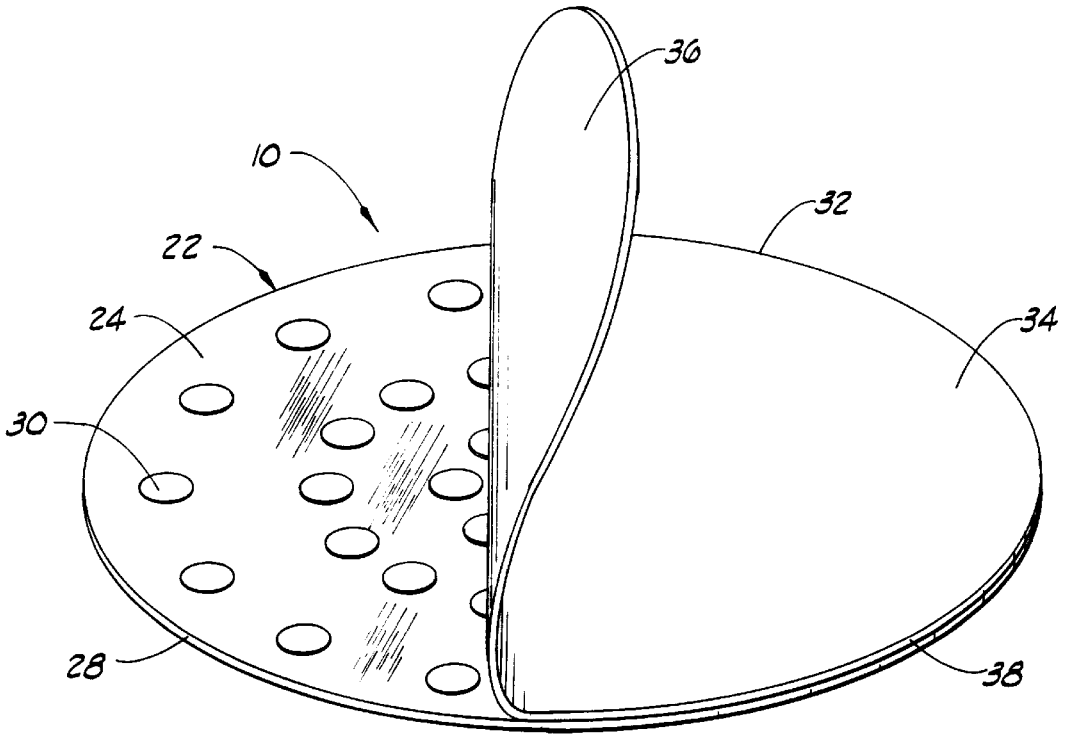
FIG. 3 is a perspective view of a modified basket wrapping material constructed exactly like the material of FIGS. 1–1A, but showing a release strip partially connected thereto.
Figure 7:
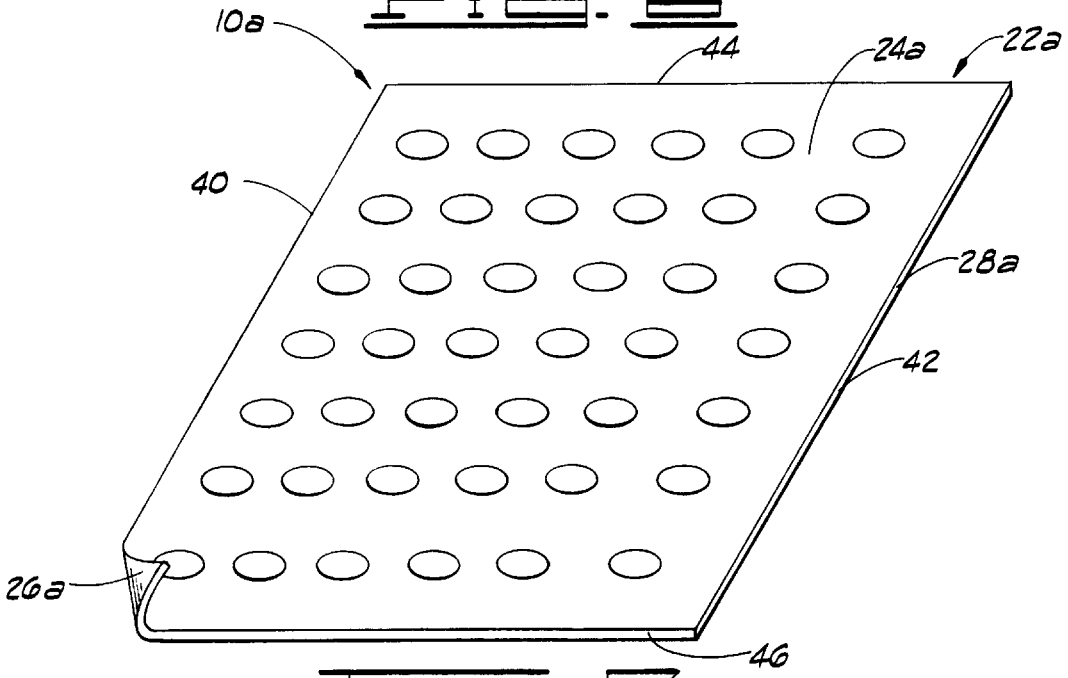
FIG. 7 is a perspective view of another modified basket wrapping material.
Figure 9:
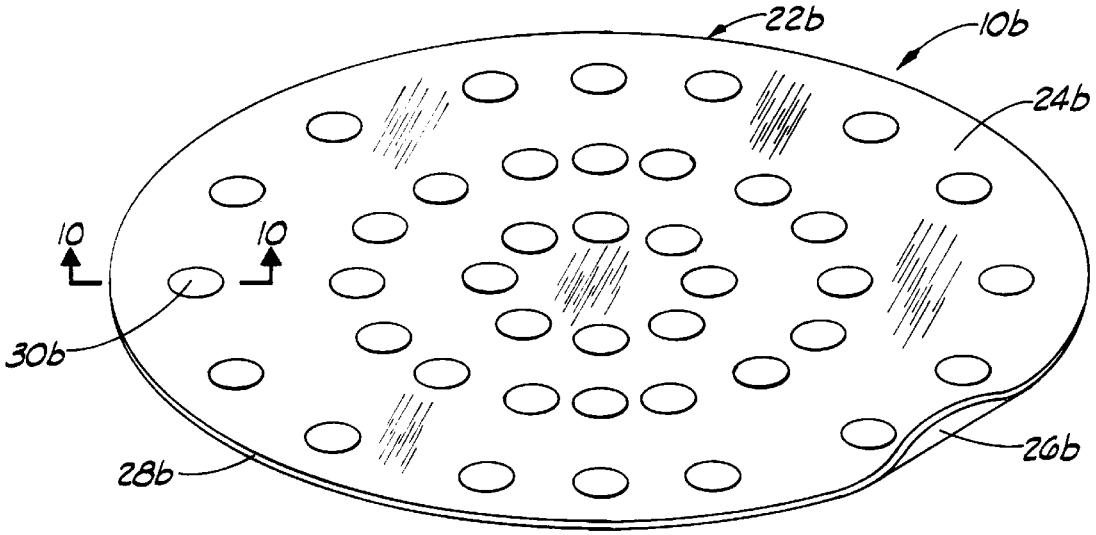
FIG. 9 is a perspective view of yet another modified basket wrapping material.
Figure 10:
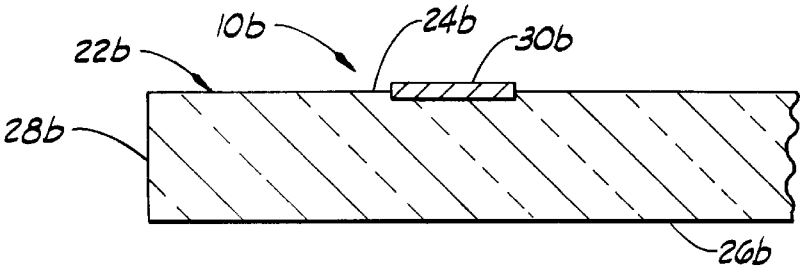
FIG. 10 is a cross-sectional partial view of FIG. 9 taken substantially along the lines 10—10 of FIG. 9.

As shown in FIGS. 1 and 1A, a plurality of bonding material spots 30 are disposed on the upper surface 24 of the sheet of material 22 (only one of the plurality of bonding material spots is identified by the numeral 30). While the bonding material spots 30 are shown herein disposed on the upper surface 24 of the sheet of material 22, it will be appreciated that the bonding material spots 30 may be disposed on the lower surface 26, or the bonding material spots 30 may be disposed both on the upper surface 24 and the lower surface 26 of the sheet of material 22. These "spots" 30 comprise a bonding material which may, as illustrated in FIGS. 1–1A and 3, comprise an adhesive. Alternatively, the bonding material spots 30 may comprise a cohesive, as shown in FIG. 7. In addition, the bonding material spots 30 may comprise an adhesive/cohesive combination, that is, some bonding material spots may be adhesive, while other bonding material spots may be cohesive (not shown). The bonding material spots 30 may cover substantially the entire upper surface 24 of the sheet of material 22. Or, in a further alternative, the bonding material spots 30 may comprise a second material (as shown in FIGS. 9–10) having at least a portion thereof impregnated with a bonding material spot 30 or a plurality of bonding material spots 30 (i.e., a bonding material comprising an adhesive, a cohesive, or an adhesive/cohesive combination). The bonding material spots 30 may also only be disposed in certain locations on the sheet of material 22. Any material known in the art and commercially available which is capable of retaining one or more bonding material spots 30 disposed thereon and/or incorporated therein may be utilized.

The bonding material spots 30 impart sufficient adhesion, and/or cohesion to permit the sheet of material 22 to be disposed about the outer surface 18 of the basket 12, with the upper surface 24 of the sheet of material 22 disposed adjacent to the outer surface 18 of the basket 12 so that the bonding material spots 30 on the sheet of material 22 contact the outer surface 18 of the basket 12 for adhesively, and/or cohesively connecting the sheet of material 22 to the outer surface 18 of the basket 12. That is, the upper surface 24 of the sheet of material 22 via the bonding material spots 30 thereon connects to the outer surface 18 of the basket 12, the upper surface 24 of the sheet of material 22 may alternatively connect to like portions of itself as well, as shown in FIGS. 5 and 6. In this manner, a customized fit of the sheet of material 22 to the outer surface 18 of the basket 12 is obtained, even when the sheet of material 22 is shaped and sized differently than the basket 12. It will be appreciated that when the sheet of material 22 is placed about a basket 12, the sheet of material 22 covers substantially the entire outer surface 18 of the basket 12. It will also be appreciated that the bonding material spots 30 illustrated in FIGS. 1–6 comprise an adhesive.

The bonding material spots 30 may comprise a plurality of bonding material spots 30 extending over the upper surface 24 of the sheet of material 22, as shown in FIG. 1. The bonding material spots 30 may comprise one or a plurality of strips (FIG. 3), or alternatively, a variety of shapes and designs, which may be geometric (squares, rectangles, triangles, and the like), or fanciful, or abstract and/or asymmetrical (for example, hearts, flowers, slogans, printed letters or numbers, characters), or any combination thereof. It will be appreciated that the bonding material spots 30 may vary, spot-to-spot, with regard to size, shape, and placement on the sheet of material 22.

The bonding material spots 30 shown in all embodiments herein may comprise one or a variety of colors. Ink, dye, pigments, or any combination thereof of any color or combination of colors can be mixed with the bonding material spots 30, to create colored bonding material spots 30. It will be appreciated that all bonding material spots 30 described and illustrated herein are substantially flat.

The bonding material spots 30 are disposed on the upper surface 24 of the sheet of material 22 by spraying, lacquering, or painting such bonding material thereupon. Alternatively, the bonding material spots 30 may be disposed upon the sheet of material 22 by any method known in the art. The bonding material spots 30 are also disposed on a basket 12 by any method described and/or shown herein. The bonding materials (adhesive, cohesive, or combinations thereof) described herein are well known in the art and commercially available.

The bonding material spots 30 convey non-permanent fastening properties to the sheet of material 22, and to the basket 12, permitting the sheet of material 22 to engagingly contact and connect to the basket 12. "Non-permanent fastening properties," as used herein, means that the spots 30 permit the sheet of material 22 to engagingly contact and connect to the outer surface 18 of the basket 12, or alternatively, the outer surface of the sheet of material 22. These same non-permanent fastening properties of the bonding material spots 30 permit a firm yet temporary engagement of the sheet of material 22 to the outer surface 18 of the basket 12, or of the sheet of material to itself. Such non-permanent fastening properties also permit the quick and easy removal of the sheet of material 22 from the basket 12. The bonding material spots 30 have non-permanent fastening properties which provide sufficient strength of engagement to firmly contact and hold the sheet of material 22 to the outer surface 18 of the basket 12, yet these same non-permanent fastening properties also permit the ready release of the sheet of material 22 from the basket 12 when the sheet of material 22 is pulled away therefrom, without causing portions of the sheet of material 22 to remain attached to the basket 12. Such "non-permanent fastening properties" are found in the adhesives, particularly, but not by way of limitation, pressure-sensitive adhesives, and in some cohesives. Adhesives and/or cohesive bonding materials having permanent fastening properties may alternatively be utilized.

As illustrated in FIG. 3, the bonding material spots 30 on the upper surface 24 of the sheet of material 22 may be covered with at least one release strip 32. The release strip 32 is used to protect the bonding material spots 30 before the upper surface 24 of the sheet of material 22 and the bonding material spots 30 thereon is disposed adjacent the outer surface 18 of the basket 12. The release strip 32 has an upper surface 34, a lower surface 36, and an outer periphery 38. The lower surface 36 of the release strip 32 is disposed adjacent the bonding material spots 30 on the upper surface 24 of the sheet of material 22. It will be appreciated that the release strip 32 is also substantially flat.

Figure 4:
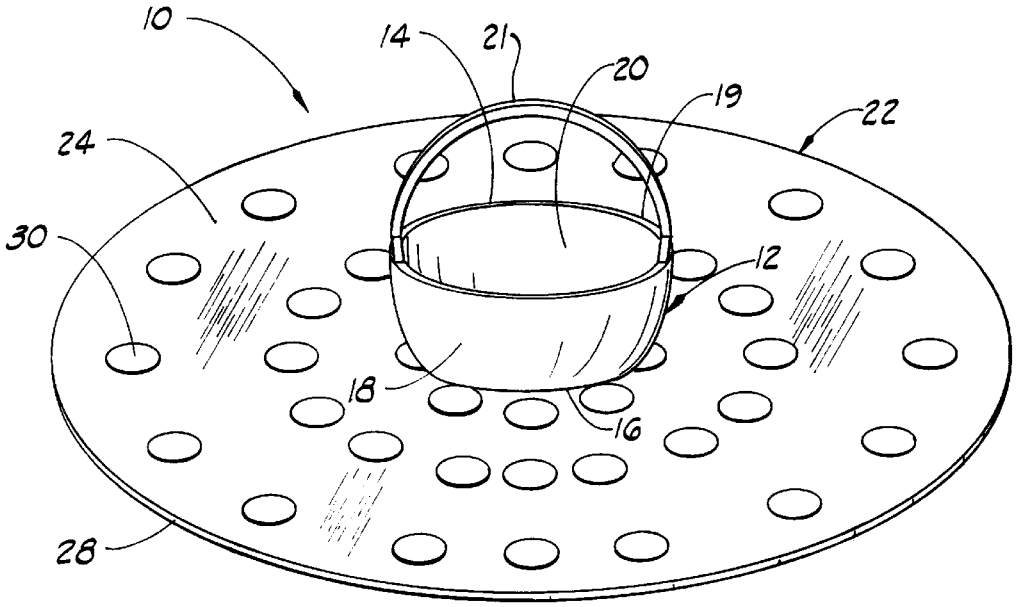
FIG. 4 is perspective view showing one method of disposing a basket on a basket wrapping material.
Figure 5:
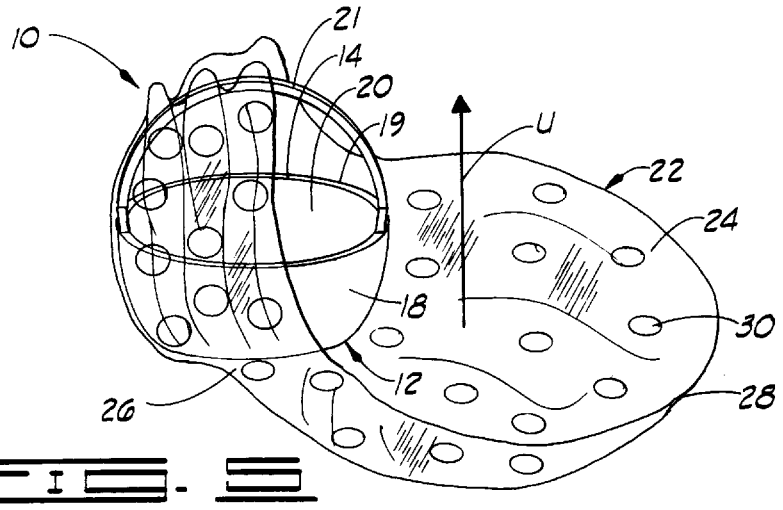
FIG. 5 is a perspective view of the basket and basket wrapping material shown in FIG. 4, showing a basket partially wrapped.
Figure 6:
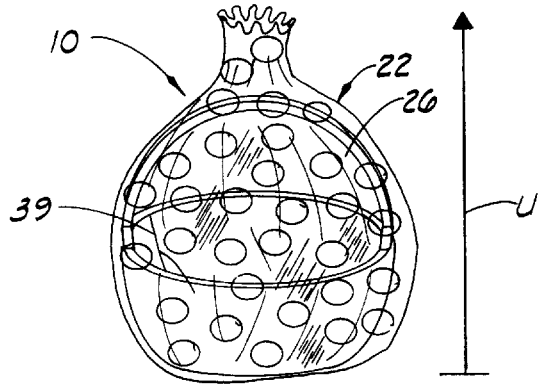
FIG. 6 is a perspective view of the basket and basket wrapping material shown in FIGS. 4 and 5, showing a basket wrapped.

FIGS. 4–6 illustrate one method of use of the present invention. First, a sheet of material 22 and a basket 12, as described in detail above, are provided. The release strip 32 is removed from the upper surface 24 of the sheet of material 22. Then, the sheet of material 22 is placed on a relatively horizontal surface with the lower surface 26 of the sheet of material 22 adjacent to the horizontal surface. A basket 12 is then placed in the approximate center of the upper surface 24 of the sheet of material 22. The bonding material spots 30 on the upper surface 24 are thereby disposed adjacent to and engagingly contact the outer surface 18 of the basket 12 contacting the sheet of material 22. An operator then spreads and disposes the sheet of material 22 upward, in a general direction U over the outer surface 18 of the basket 12 to permit the bonding material spots 30 on the upper surface 24 of the sheet of material 22 to be disposed adjacent to and engagingly contact a greater surface area of the outer surface 18 of the basket 12, and to simultaneously engagingly contact like portions of itself as well, for connecting both one like portion of the upper surface 24 of the sheet of material 22 to at least one other like portion thereof, creating overlapping folds 39, the sheet of material 22 thereby simultaneously contacting and connecting to the outer surface 18 of the basket while conforming to the outer surface 18 of the basket 12. The bonding material spots 30 on the upper surface 24 of the sheet of material 22 engagingly contact the outer surface 18 of the basket 12 thereby connecting the sheet of material 22 to the outer surface 18 of the basket 12. The connections of the sheet of material 22 to like portions thereof, creating overlapping folds 39, and to the outer surface 18 of the basket 12 produces a contoured and customized fit of the sheet of material 22 to the outer surface 18 of the basket 12. The operator continues to dispose the sheet of material 22 upward, in the general direction U, continuing to connect the sheet of material 22 to the outer surface 18 of the basket 12 while substantially covering, surrounding and encompassing the outer surface 18 of the basket 12 with the sheet of material 22, and substantially enclosing the basket 12 in the sheet of material 22 by twisting the remaining portions of the sheet of material 22 which extend above the basket 12 together (not shown), or by pressing them together (FIG. 6), or by using a twist tie (not shown), or by any method or means shown and described herein.

Unless the sheet of material 22 is precisely sized to fit the outer surface 18 of the basket 12, overlapping folds 39 (only one such overlapping fold being designated with a reference numeral and shown in FIG. 6) are formed in the sheet of material 22. The overlapping folds 39 extend at different angles and over different lengths, and permit the sheet of material 22 to conform to the contours of the outer surface 18 of the basket 12 to create a contoured and customized fit of the sheet of material 22 to the basket 12.

Figure 8:
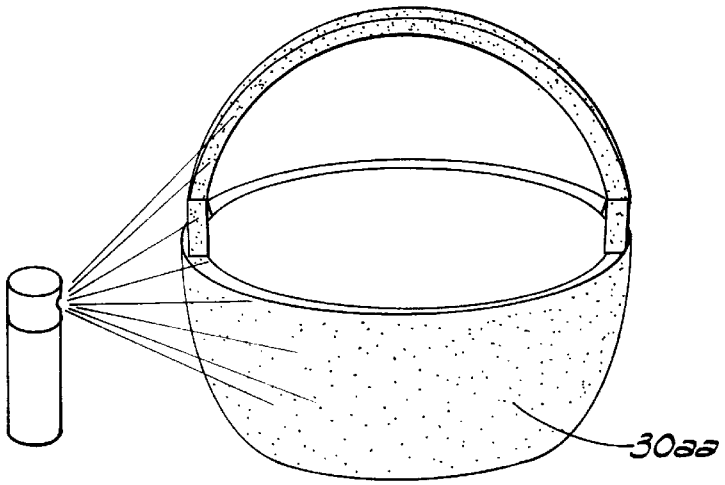
FIG. 8 is a perspective view of a modified basket.

Embodiments of FIGS. 7–8

Shown in FIGS. 7–8 is a modified basket wrapping material cohesive which is constructed exactly like the basket wrapping material 10 shown in FIGS. 1–1A, and described in detail previously, except that the sheet of material 22*a* is square instead of round, and the plurality of bonding material spots 30*a* on the upper surface 24*a* of the sheet of material 22*a* comprise a cohesive.

The outer periphery 28*a* of the sheet of material 22*a* is comprised of four sides, namely a first side 40, a second side 42, a third side 44, and a fourth side 46. The basket 12*a* comprises a basket identical to the one shown and described in detail previously in FIG. 2, except at least one bonding material spot 30*a* a is disposed on the outer surface 18*a* of the basket 12*a*, the bonding material spot 30*aa* generally conforming to the outer surface 18*a* and substantially covering the outer surface 18*a* of the basket 12*a*. The bonding material spot 30*aa* comprises a cohesive. The spot 30*aa* may be disposed on the basket by any method shown or described herein.

After the bonding material spot 30*aa* has been disposed on the basket 12*a*, the basket 12*a* may be wrapped in the sheet of material 22*a*. The sheet of material 22*a* is disposed about the basket 12*a* by exactly the same method shown in FIGS. 1–6 and previously described herein in detail. It will be appreciated the overlapping folds 39 (shown in FIG. 6, only one such overlapping fold being designated with a reference numeral) are formed in the sheet of material 22*a*, and created by one portion of the upper surface 24*a* sheet of material 22*a* and the bonding material spots 30*a* thereon (cohesive) contacting a similar portion thereof, and contacting the outer surface 18*a* of the basket 12*a* having bonding material spots 30*aa* thereon (which also comprises a cohesive). The overlapping folds 39 extend at different angles and over different lengths, and permit the sheet of material 22*a* to conform to the contours of the outer surface 18*a* of the basket 12*a* to create a customized fit of the sheet of material 22*a* to the basket 12*a* (not shown).

The Embodiments of FIGS. 9–10

Illustrated in FIGS. 9–10 is a modified basket wrapping material 10*b* which is constructed exactly like the basket wrapping material 10 shown in FIGS. 1–6, and described in detail previously, except that the sheet of material 22*b* has bonding material spots 30*b* on the upper surface 24*b* of the sheet of material 22*b* which comprise a second material which comprises an adhesive.

The second material is incorporated partially (shown in FIG. 10) or completely (not shown) in the upper surface 24*b* of the sheet of material 22*b* during the extrusion process. The extrusion of man-made polymers into film is well-known in the art. Alternatively, the bonding material spots 30*b* may be fastened to the sheet of material 22*b* by heat sealing the bonding material spots 30*b* to the sheet of material 22*b*, or, the bonding material spots may be capable of connecting and fastening themselves to the sheet of material 22*b*, due to their composition, that is, the adhesive, the cohesive, or the adhesive/cohesive combination. It will be understood that the bonding material spots 30*b* may be fastened to the sheet of material 22*b*, or alternatively, to the basket 12*b* (not shown), or both (not shown), by any method shown and/or described herein.

A basket 12*b* (not shown) may be wrapped in the sheet of material 22*b*. The sheet of material 22*b* is disposed about the basket 12*b* by exactly the same method shown in FIGS. 1–6 and previously described herein in detail.

Figure 11:
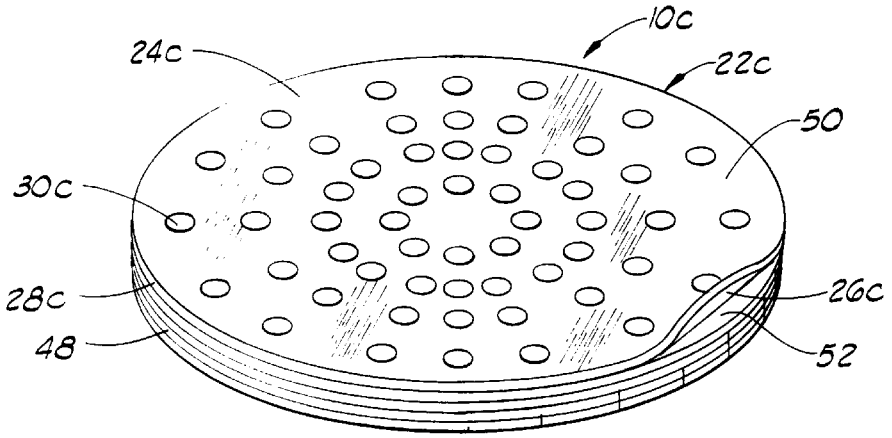
FIG. 11 is a perspective view of yet another modified basket wrapping material, showing a pad of sheets of materials.
Figure 12:
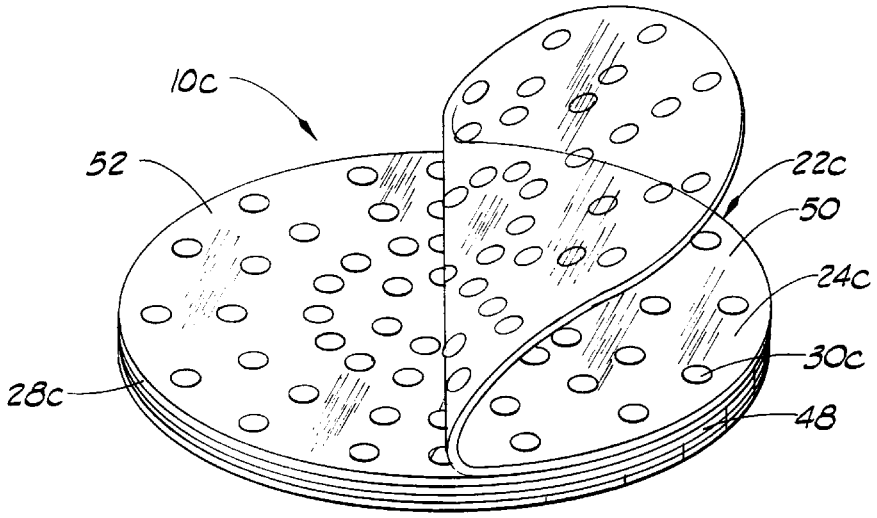
FIG. 12 is a perspective view of FIG. 11, showing a sheet of material partially connected to the pad of sheets of materials.
Figure 13:
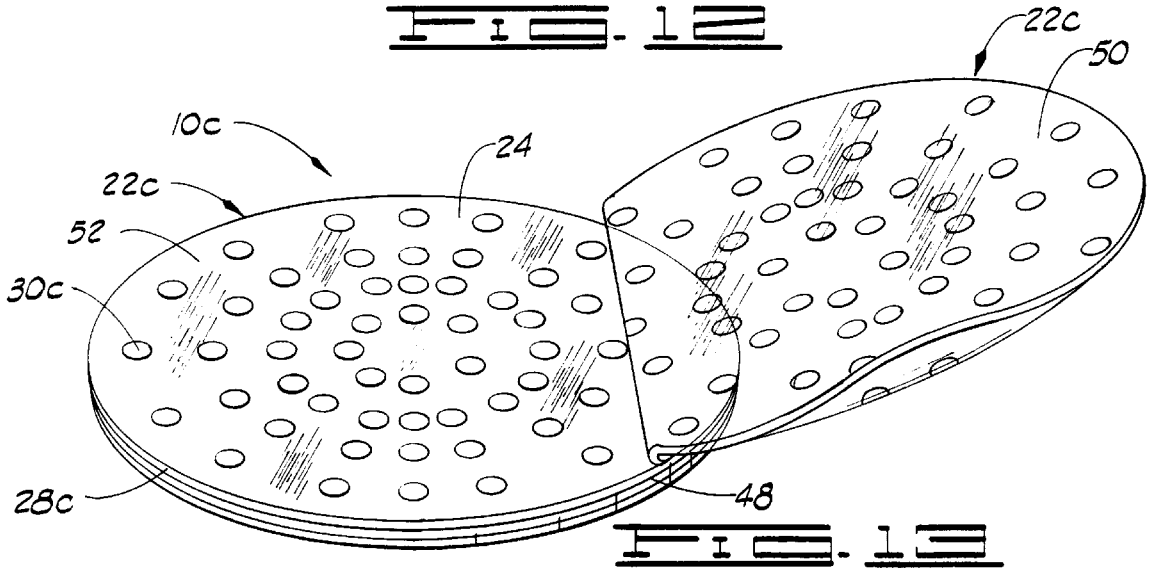
FIG. 13 is a perspective view of the basket wrapping material shown in FIGS. 11 and 12, showing a sheet of material completely disconnected from the pad of sheets of materials.

The Embodiments of FIGS. 11–13

A further embodiment and method of use is shown in FIGS. 11–13. The basket wrapping material 10*c* is made in accordance with the embodiments shown and described in FIGS. 1–6 except a plurality of sheets of material 22*c* are connected together to form a pad 48 of sheet of material 22*c*. The pad 48 comprises a plurality of sheet of material 22*c* stacked one on top of the other and positioned so that the periphery 28*c* of the sheets of material 22*c* in the pad 48 are generally aligned about the edges thereof.

The pad 48 further comprises a top sheet of material 50, which is the upper-most sheet of material 22*c* in the pad 48, and a next sheet of material 52 disposed immediately thereunder, the other sheets of material 22*c* being disposed under the next sheet of material 52 in the pad 48. Each sheet of material 22*c* has bonding material spots 30*c* disposed thereon, preferably on the upper surface 24*c* of each sheet of material 22*c*, which are adjacent to and engagingly contact the sheet of material 22*c* just below it in the pad 48 of sheets of material 22*c*. The bonding material spots 30*c* on each sheet of material 22*c* fastens and connects to a portion of another sheet of material 22*c* for cooperating to connect the sheets of material 22*c* into the pad 48.

Each top sheet of material 50 and the pad 48 of sheets of material 22*c* may be removed by lifting the top sheet of material 50 and releasably detaching the top sheet of material 50 from the next sheet of material 52. In this manner, the next sheet of material 52 becomes the new top sheet of material 50 and the sheet of material 22*c* below the new top sheet of material 50 becomes the new next sheet of material 52.

A method of use is illustrated by FIGS. 12–13. A plurality of sheets of material 22*c* in a pad 48, as previously described, are provided. The operator generally grasps the top sheet 50 in the pad 48 of sheets of material 22*c* near the periphery 28*c* thereof and lifts the sheet 22*c*, thereby releasably detaching a portion of the top sheet 50 from the upper surface 24*c* of the next sheet of material 52, as shown in FIG. 12. The operator continues to lift the top sheet 50, and by lifting and releasably pulling the top sheet 50 away from the next sheet of material 52, as shown in FIG. 13, the operator then releasably disconnects the top sheet of material 50 from the next sheet of material 52 disposed under the top sheet of material 50 in the pad 48.

A basket 12*c* (not shown) may then be wrapped using the disconnected sheet of material 22*c*. The sheet of material 22*c* is disposed about the basket 12*c* by exactly the same method shown in FIGS. 1–6 and previously described herein in detail.

It will be appreciated that when the top sheet of material 50 has been releasably disconnected from the pad 48 in the manner just described, the next sheet of material 52, under the top sheet of material 50, then provides a new top sheet of material 50 and the process can be repeated for disconnecting additional sheets of material 22*c*.

Figure 14:
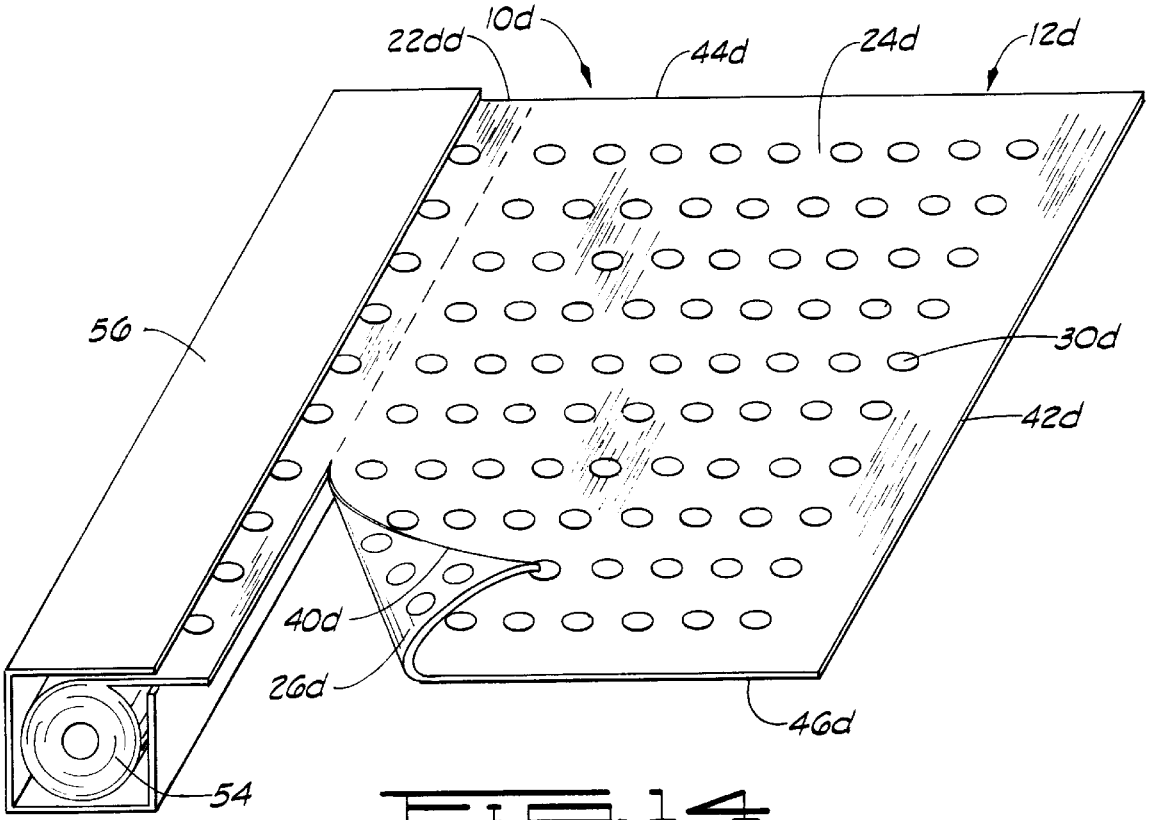
FIG. 14 is perspective view of a plurality of basket wrapping materials, but formed into a continuous roll of material disposed in a dispenser.

The Embodiment of FIG. 14

FIG. 14 shows another embodiment and method of use of the present invention. The basket wrapping material 10*d* is exactly like the basket wrapping material 10 shown in FIG. 7 and described in detail previously, except that the basket wrapping material 10*d* is contained as a roll 54 and a dispenser 56. The plurality of sheets of material 22*d* and the roll 54 are connected by perforations (the sheet of material 22*d* shown partially detached and turned upward for illustration purposes only). Alternatively, the roll 54 may simply be formed as a continuous roll 54 without perforations, and the basket wrapping material 10*d* may be severed into separate sheets of material 22*d* by a serrated cutting edge (not shown) contained within the dispenser 56, or by a separate cutting element (not shown). Any number of sheets of material 22*d* may form the roll 54 as long as it is possible to withdraw at least one sheet of material 22*d* from the roll 54, as described previously.

Optionally, a release strip (not shown, but like the release strip 32 described previously) may be used to cover the upper surface 24*d* of the sheet of material 22*d*. It will be appreciated that the release strip 32 will detach from the roll 54 in the same manner and simultaneously, with the detachment of the sheet of material 22*d*.

Referring to FIG. 14, after being withdrawn and detached from the roll 54, the sheet of material 22*d* is disposed about the basket 12*d* by exactly the same method shown in FIGS. 1–6 and 7–8, and previously described herein in detail.

Figure 15:
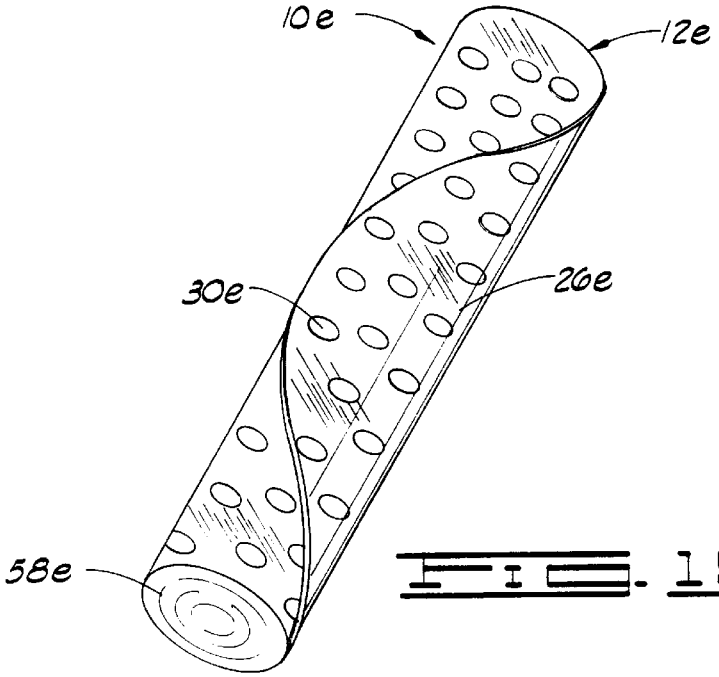
FIG. 15 is a perspective view of the material of FIGS. 1–1A, but formed into a roll of material comprising a single sheet of material.

Embodiments of FIG. 15

Illustrated in FIG. 15 is a modified basket wrapping 10*e* which is constructed exactly like the basket wrapping material 10 shown in FIGS. 1–6 and described in detail previously, except that the sheet of material 22*e* is rolled into a continuous roll 58 of basket wrapping material 10*e* without a dispenser. In this embodiment, only one sheet of material 22*e* is included in the roll 58, although a plurality of sheets of material 22*e* could be included in the roll 58. The rolled sheet of material 22*e* acts as its own release strip, thereby protecting the bonding material spots 30*e* on the upper surface 24*e* of the sheet of material 22*e*.

Referring to FIG. 15, the sheet of material 22*e* is rolled out and disposed about the outer surface 18*e* of a basket 12*e* (not shown) by exactly the same method shown in FIGS. 1–6, and previously described in detail herein.

Figure 16:
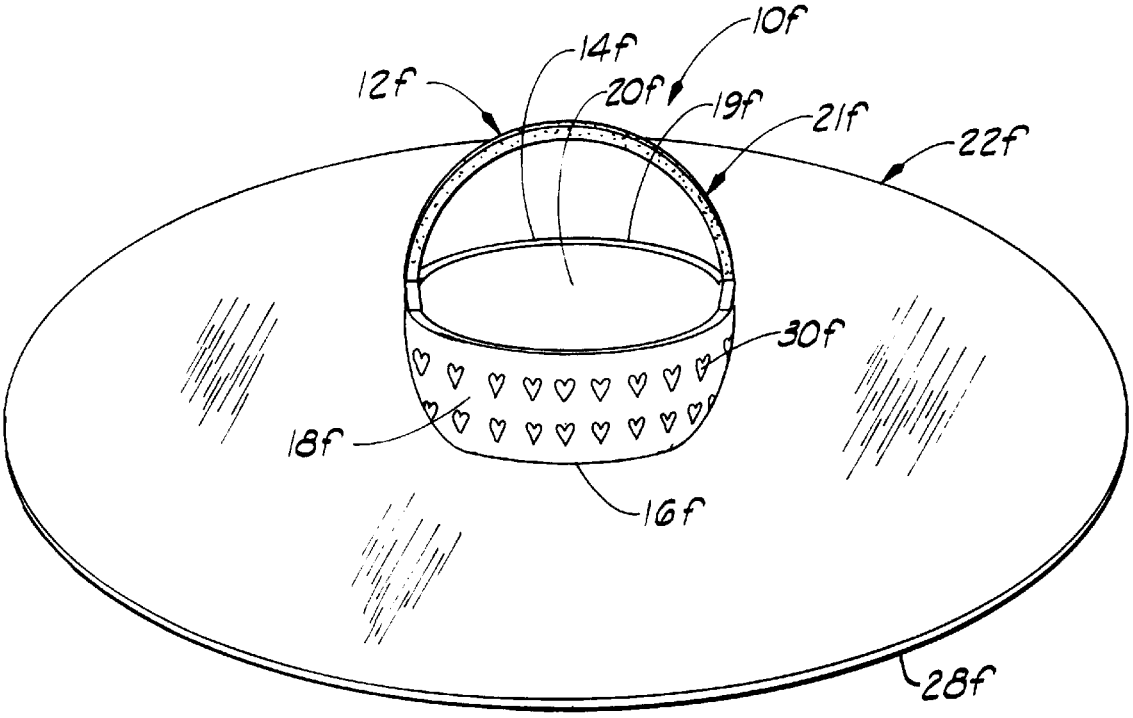
FIG. 16 is a perspective view of still another modified basket and basket wrapping material, showing a basket disposed on the material.

Embodiments of FIG. 16

Disclosed in FIG. 16 is a modified basket wrapping material 10*f* which is constructed exactly like the basket wrapping material 10 shown in FIGS. 1–6, and described in detail previously, except that the bonding material spots 30*f* are disposed on the outer surface 18*f* of the basket 12*f*, the bonding material spots 30*f* comprise an adhesive, and the sheet of material 22*f* does not comprise bonding material spots 30*f*.

It will be appreciated that the bonding material spots 30*f* covering the outer surface 18*f* of the basket 12*f* may comprise a solid section, or, alternatively, bonding material spots as previously described, or any combination thereof. In the present embodiment, the bonding material spots 30*f* on the base portion of the basket 12*f* comprise hearts, while on the handle 21*f*, the bonding material spots 30*f* comprise a solid strip. While the bonding material spots 30*f* comprise an adhesive, it will be appreciated that the bonding material spots 30*f* could also comprise a second material, comprising an adhesive, a cohesive, or an adhesive/cohesive combination, as previously described herein.

Referring to FIG. 16, the sheet of material 22*f* is disposed about the basket 12*f* by exactly the same method shown in FIGS. 4–6, and previously described in detail herein.

In a further embodiment (not shown), it will also be appreciated that the bonding material spots could also be disposed both on the outer surface of the basket and on the upper surface of the sheet of material. In this embodiment, the sheet of material would be wrapped about the basket by any method previously shown and/or described herein.

The Embodiments and Methods of FIGS. 17–22

Disclosed in FIGS. 17–22 is a modified basket wrapping material log which is constructed exactly like the basket wrapping material 10 shown in FIGS. 1–6, and described in detail previously, except that a plurality of bonding material spots 30*g* are disposed in a particular arrangement on the upper surface 24*g* of the sheet of material 22*g*, the plurality of bonding material spots 30*g* being arranged such that said bonding material spots 30*g* cooperate to provide both a bow 60 at the top of the wrapped basket and a closure of the sheet of material 22*g* about a basket 12*g*. Both the bow 60 and the closure are formed when the plurality of bonding material spots 30*g* are connected together in the method described below.

It will be understood that the plurality of bonding material spots 30*g* disposed on the sheet of material 22*g* provide one schematic example of forming a combined closure and bow 60. It will also be understood by those having ordinary skill in the art, after viewing the present disclosure, that the plurality of bonding material spots 30*g* may be arranged in a different manner, and still form the combined and simultaneous bow 60 and closure.

Figure 17:
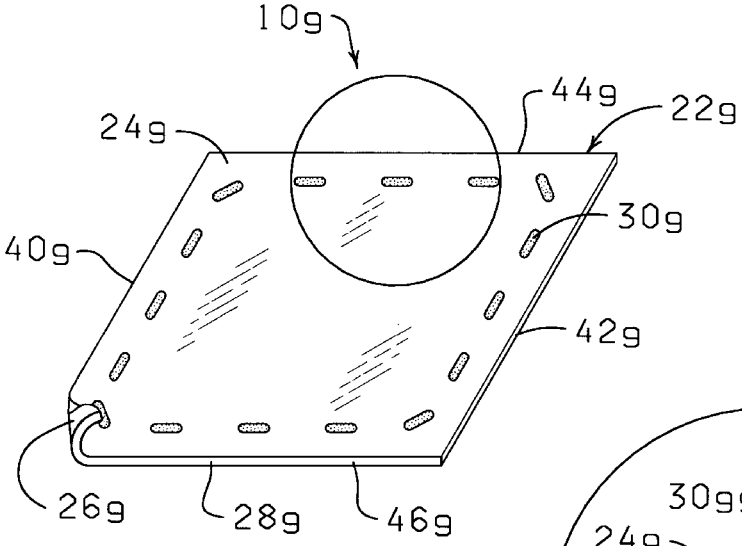
FIG. 17 is a schematic perspective view of a modified basket wrapping material made in accordance with the present invention, showing an area encircled for use in sectional views.
Figure 18:
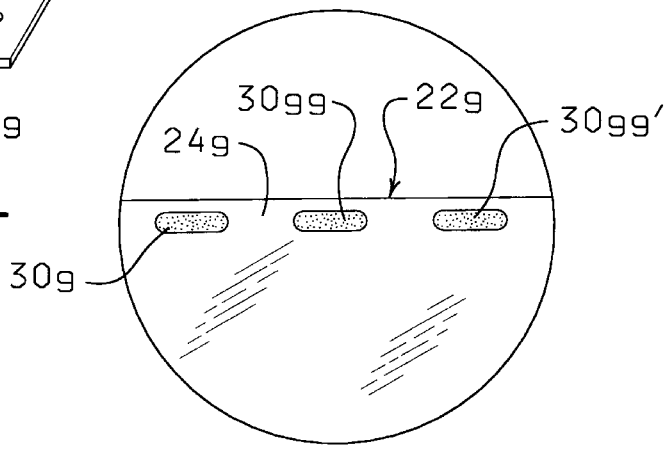
FIG. 18 is an enlarged schematic perspective sectional view of the modified basket wrapping material of FIG. 17, showing a portion of the plurality of bonding material spots.
Figure 19:
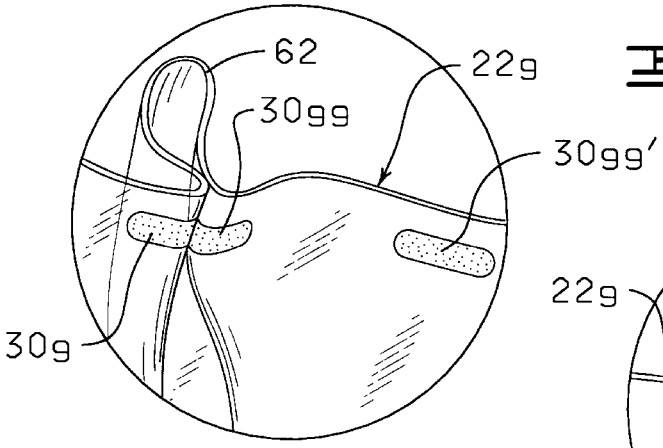
FIG. 19 is an enlarged schematic perspective sectional view of the modified basket wrapping material of FIG. 18, but showing the bonding of a portion of two of the plurality of bonding material spots resulting in the formation of a loop of basket wrapping material.
Figure 20:
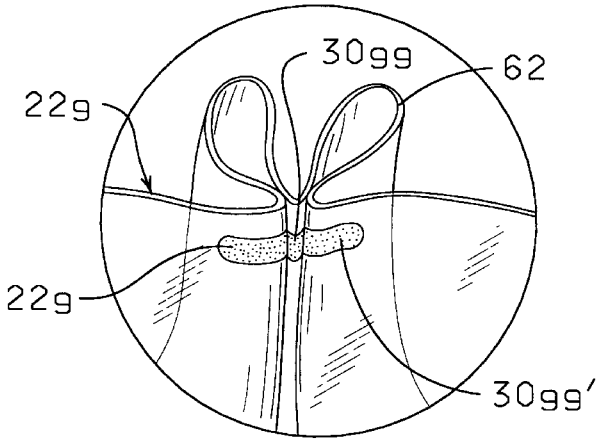
FIG. 20 is an enlarged schemative perspective view of the modified basket wrapping material of FIG. 19, but showing the bonding of another portion of two of the plurality of bonding material spots resulting in the formation of an additional loop of basket wrapping material.
Figure 21:
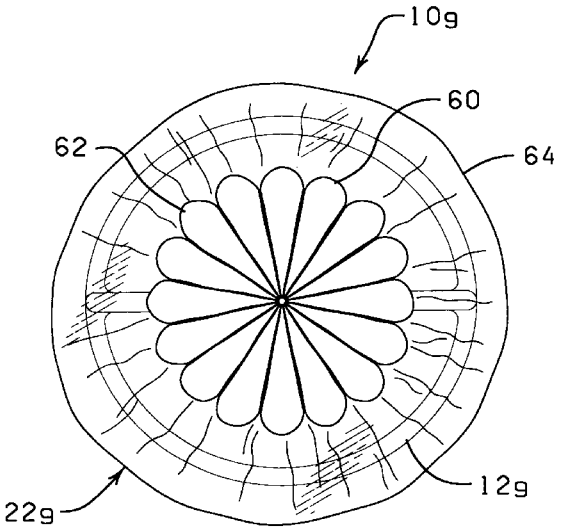
FIG. 21 is a top plan view of a basket wrapped in accordance with the present invention as illustrated in FIG. 17, showing the bow formed from loops formed in the basket wrapping material.
Figure 22:
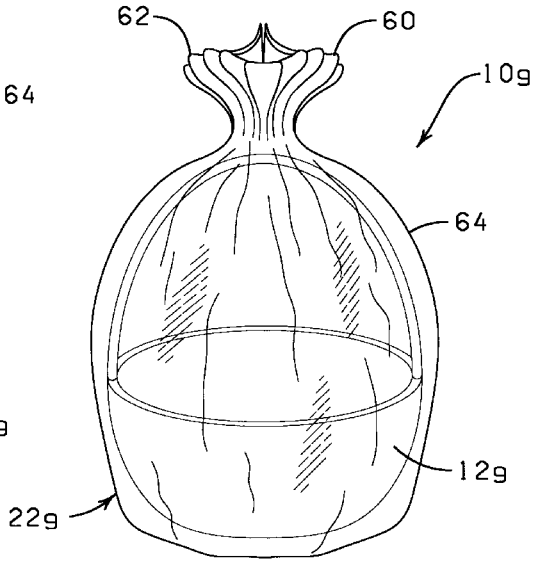
FIG. 22 is a side elevational view of the wrapped basket of FIG. 21, showing the formed bow and closure of the basket wrapping material about the basket.

The sheet of material 22*g* shown in FIG. 17 and described in detail herein has a plurality of oval-shaped bonding material spots 30*g* numbering, but not by way of limitation, sixteen oval-shaped bonding material spots 30*g* in the present embodiment, which are disposed on the upper surface 24*g* of the sheet of material and positioned near and around the outer periphery 28*g* of the sheet of material in a generally symmetrical manner. FIGS. 18–20 show a sectional view of a portion of the upper surface 24*g* of the sheet of material 22*g* near the third side 44*g* of the sheet of material 22*g* shown in FIG. 17, the sectional view taken from the area encircled. FIG. 19 shows, in part, the beginning of the formation of both the bow 60 and the closure of the sheet of material 22*g* which is after a basket 12*g* has been disposed on the sheet of material 22*g* and the sheet of material 22*g* is wrapped about the outer surface 18*g* of the basket 12*g*. FIG. 19 shows one of the plurality or loops which forms both the bow 60 and the closure, while FIG. 20 shows two of the plurality of loops.

In a general method of use, as illustrated in FIGS. 17–22, a sheet of material 22*g* is provided, and a basket 12*g* is disposed thereupon (shown above). The sheet of material 22*g* is gathered about the basket 12*g* in any method previously shown or described herein. The outer periphery 28*g* of the sheet of material 22*g* is extended above basket 12*g*. Then, the method disclosed in FIGS. 19–22 is begun. That is, one-half of each spot 30*g* is connected to one-half of the nearest adjacent spot 30*g*. For purposes of illustration only, three of the plurality of bonding material spots 30*g* illustrated in FIGS. 18–20 are numbered as bonding material spots 30*g*, 30*gg* and 30*gg*', respectively. As shown in FIG. 19, one-half of bonding material spot 30*g* is bonded to one-half of bonding material spot 30*gg* to form one of the plurality of loops 62 (only one loop designated by the numeral 62) which form both the bow 60 and the closure. As illustrated in FIG. 20, one-half of bonding material spot 30*gg* is then bonded to one-half of bonding material spot 30*gg*' to form yet another of the plurality of loops 62. This process is continued until all of the plurality of bonding material spots 30*g* are connected together by the method disclosed herein and illustrated in FIGS. 18–22.

It will be appreciated that a certain amount of crimping may be provided below the bow 60, but it will also be appreciated that the sheet of material 22*g* will naturally crimp itself somewhat below the bow 60 in providing portions of the sheet of material which tuck inward while other portions of the sheet of material loop outward, providing the plurality of loops 62 which form the bow 60. Therefore, as shown in this embodiment, but not by way of limitation, there is a bow 60 formed which comprises a plurality of loops 62 (sixteen loops in the present embodiment) and a simultaneous closure of the sheet of material 22*g* about the basket 12*g*, said closure forming a wrapping 64 about the basket 12*g*.

In alternative embodiments, it will be appreciated that a similar closure could be created with fewer bonding material spots 30*g*, or, alternatively, by skipping every other spot, to create, for example but not by way of limitation, a bow with eight loops, or, alteratively, four loops, or any other number of loops which formed both a bow and a simultaneous closure of the sheet of material 22*g* about the basket 12*g*. That is, if only a bonding material spot 30*g* in each corner of the sheet of material 22*g* were utilized, along with a bonding material spot 30*g* disposed inbetween each corner (a total, for example only, of eight bonding material spots) then, by the method described above, said eight bonding material spots would form both a closure of the sheet of material 22*g* about the basket 12*g* and a bow 60 having eight loops 64. If only the bonding material spots 30*g* disposed in each corner of the sheet of material 22*g* were utilized, then by the method described above, said four bonding material spots 30*g* would form both a closure and a bow 60 having four loops 62. It will be apparent to one having ordinary skill in the art that disposing different numbers of bonding material spots 30*g* and differing the arrangement of the plurality of bonding material spots 30*g* on the sheet of material 22*g* will create closures and bows 60 having differing numbers and/or sizes of loops 62.

The Embodiments and Methods of FIGS. 23–28

Disclosed in FIGS. 23–28 is a modified basket wrapping material 10*h* which is constructed exactly like the basket wrapping material 10 shown in FIGS. 17–22 and described in detail previously, except that the sheet of material 22*h* is round, and the plurality of bonding material spots 30*h* disposed thereon are disposed about and near the round outer periphery 28*h* of the sheet of material 22*h* in a more asymmetrical pattern than that described above and shown in FIGS. 17–22, the plurality of bonding material spots 30*h* being each a pair of bonding material spots 30*h*. The present embodiment and method also provides a combined method of forming a bow 60 and a method of closure when the sheet of material 22*h* is wrapped about a basket 12*h* to form a wrapping 64*h*.

Figure 23:
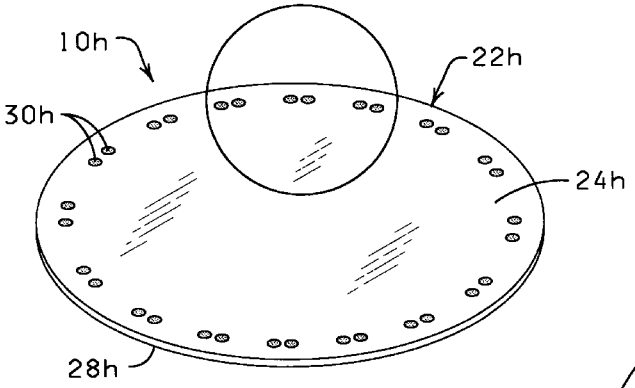
FIG. 23 is a schematic perspective view of another modified basket wrapping material made in accordance with the present invention, showing an area encircled for use in sectional views.
Figure 24:
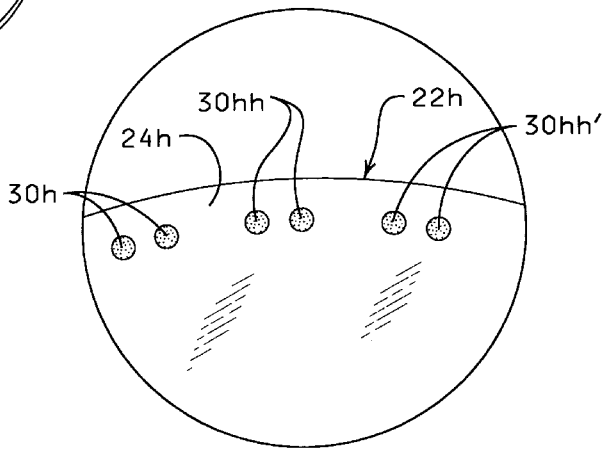
FIG. 24 is an enlarged schematic perspective sectional view of the modified basket wrapping material of FIG. 23, showing a portion of the plurality of bonding material spot pairs.
Figure 25:
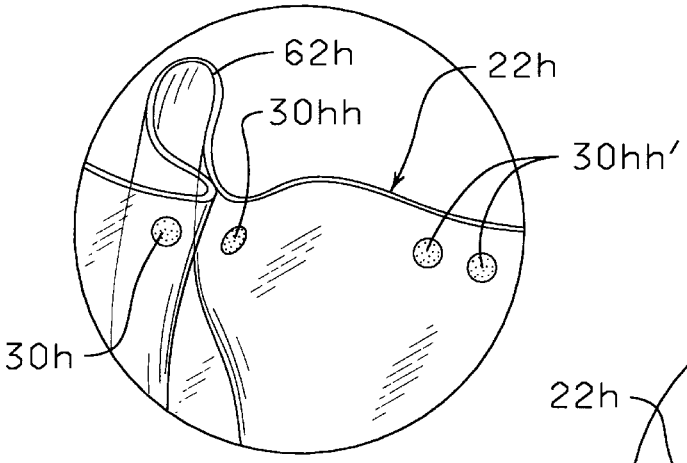
FIG. 25 is an enlarged schematic perspective sectional view of the modified basket wrapping material of FIG. 24, but showing the bonding of a portion of two of the plurality of bonding material spot pairs resulting in the formation of a loop of basket wrapping material.
Figure 26:
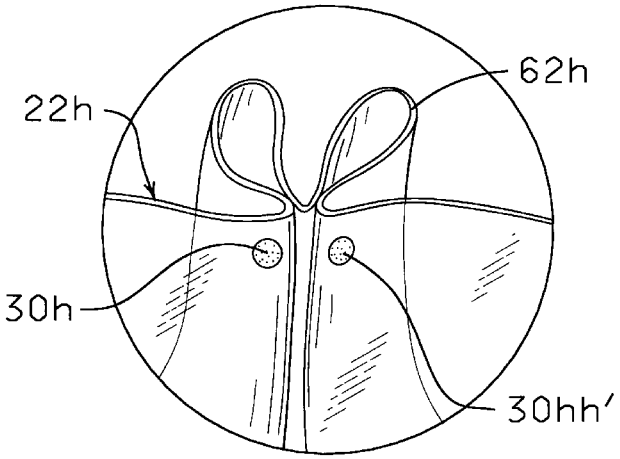
FIG. 26 is an enlarged schemative perspective view of the modified basket wrapping material of FIG. 25, but showing the bonding of another portion of two of the plurality of bonding material spot pairs resulting in the formation of an additional loop of basket wrapping material.
Figure 27:
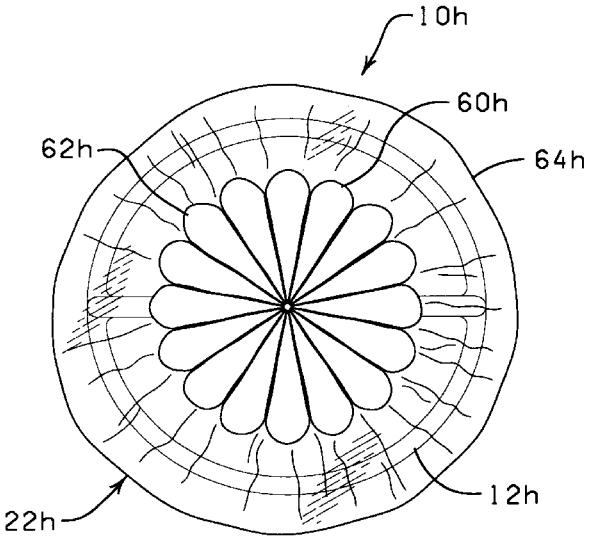
FIG. 27 is a top plan view of a basket wrapped in accordance with the present invention as illustrated in FIG. 23, showing the bow formed from loops formed in the basket wrapping material.
Figure 28:
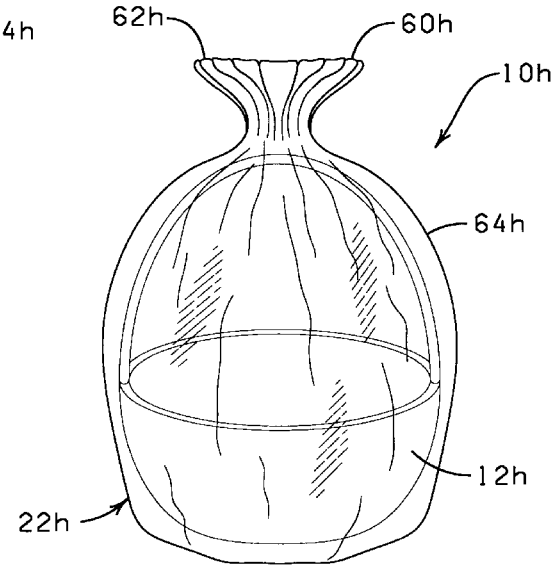
FIG. 28 is a side elevational view of the wrapped basket of FIG. 27, showing the formed bow and closure of the basket wrapping material about the basket.

The sheet of material 22*h* shown in FIG. 23 and described in detail herein has a plurality of bonding material spots 30*h* (each spot 30*h* designating the pair of spots 30*h*) disposed on the upper surface 24*h* of the sheet of material and positioned about and near the outer periphery 28*h* of the sheet of material 22*h* in a more asymmetrical pattern than that described above and shown in FIGS. 17–22. FIG. 24–26 shows a sectional view of a portion of the upper surface 24*h* of the sheet of material 22*h* near the outer periphery 28*h* said portion shown in FIG. 23, the sectional view taken from the area encircled. FIG. 25 shows, in part, the beginning of the formation of both the bow 60*h* and the closure of the sheet of material 22*h* which is after a basket 12*h* has been disposed on the sheet of material 22*h* and the sheet of material 22*h* has been wrapped about the outer surface 18*h* of the basket 12*h*. FIG. 25 shows one of the plurality of loops which forms both the bow 60 and the closure, while FIG. 26 shows two of the plurality of loops.

In a general method of use, as illustrated in FIGS. 25–28, a sheet of material 22*h* is provided, and a basket 12*h* is disposed thereupon (shown above). The sheet of material 22*h* is gathered about the basket 12*h* in any method previously shown or described herein. The outer periphery 28*h* of the sheet of material 22*h* is extended above basket 12*h*. Then, the method disclosed in FIGS. 25–28 is begun. That is, one spot 30*h* of the pair of spots 30*h* is connected to the nearest spot 30 of the nearest adjacent pair of spots 30*h*. For purposes of illustration only, three of the plurality of bonding material spot pairs 30*h* illustrated in FIGS. 24–26 are numbered as bonding material pair spots 30*h*, 30*hh* and 30*hh*', respectively. As shown in FIG. 25, the right spot of the bonding material spot pair 30*h* is bonded to the left spot of the bonding material spot pair 30*hh* to form one of the plurality of loops 62*h* (only one loop designated by the numeral 62*h*) which form both the bow 60*h* and the closure. As illustrated in FIG. 26, the right spot of the bonding material spot pair 30*hh* is bonded to the left spot of the bonding material spot pair 30*hh*' to form another of the plurality of loops 62*h*. This process is continued until all of the plurality of bonding material spots 30*h* are connected together by the method disclosed herein and illustrated in FIGS. 24–28.

It will be appreciated that a certain amount of crimping may be provided below the bow 60*h*, but it will also be appreciated that the sheet of material 22*h* will naturally crimp itself somewhat below the bow 60*h* in providing portions of the sheet of material 22*h* which tuck inward while other portions of the sheet of material 22*h* loop outward, providing the plurality of loops 62*h* which form the bow 60*h*. Therefore, as shown in this embodiment, but not by way of limitation, there is a bow 60*h* formed which comprises a plurality of loops 62*h* (sixteen loops in the present embodiment) and a simultaneous closure of the sheet of material 22*h* about the basket 12*h*, said closure forming a wrapping 64*h* about the basket 12*h*.

It will further be appreciated that, in another alternative, rather than the bonding material spot pairs 30*h*, there may instead be a provided an alternative bonding material spot pair 30*h* wherein one in the pair of spots comprises a bonding material, and wherein the other in the pair of spots comprises only a designation, such as, but not by way of limitation, a circle or spot printed on the sheet of material 22*h*, said circle or spot providing a designation as to where the adjacent bonding material spot of the adjacent bonding material spot pair 30*h* is to be adhered. This procedure is identical to that described above in detail, and as shown in FIGS. 24–26, except that, rather than adhering bonding material spot-to-bonding material spot, an operator would instead adhere a bonding material spot to a designated circle or marking. In alternative embodiments, it will be appreciated that a similar closure could be created with fewer bonding material spot pairs 30*h*, or, alternatively, by skipping every other spot, to create, for example but not by way of limitation, a bow with eight loops, or, alteratively, four loops, or any other number of loops which formed both a bow and a simultaneous closure of the sheet of material 22*h* about the basket 12*h*. That is, if only a bonding material spot pair 30*g* in each corner of the sheet of material 22*g* were utilized, along with a bonding material spot pair 30*g* disposed inbetween each corner (a total, for example only, of eight bonding material spot pairs) then, by the method described above, said eight bonding material spot pairs would form both a closure of the sheet of material 22*h* about the basket 12*h* and a bow 60*h* having eight loops 62*h*. If only the bonding material spot pairs 30*h* disposed in each corner of the sheet of material 22*h* were utilized, then by the method described above, said four bonding material spot pairs 30*h* would form both a closure and a bow 60*h* having four loops 62*h*. It will be apparent to one having ordinary skill in the art that disposing different numbers of bonding material spots 30*h* and differing the arrangement of the plurality of bonding material spot pairs 30*h* on the sheet of material 22*h* will create closures and bows 60*h* having differing numbers and/or sizes of loops 62*h*.

Figure 29:
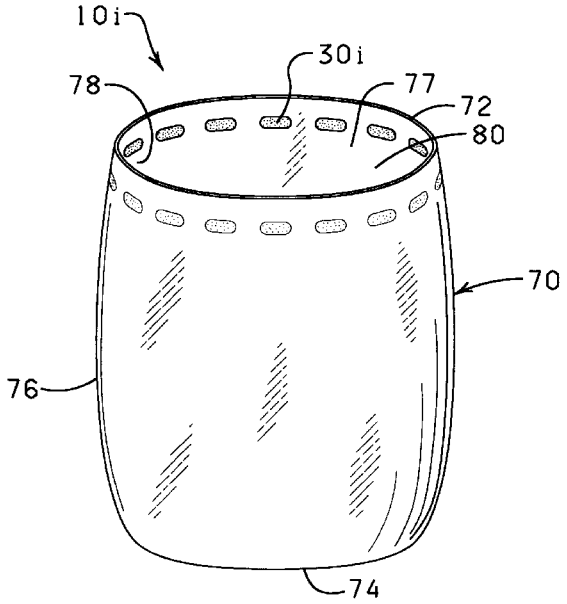
FIG. 29 is a schematic perspective view of another modified basket wrapping material made in accordance with the present invention, showing the sheet of material formed into a bag.
Figure 30:
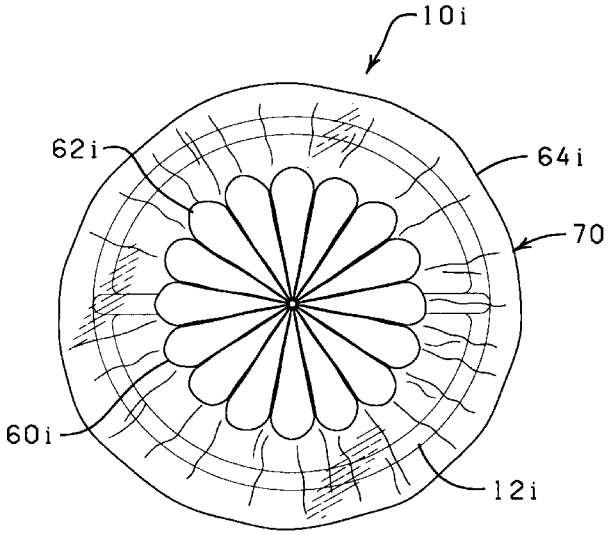
FIG. 30 is a top plan view of a basket wrapped in accordance with the present invention as illustrated in FIG. 29, showing the bow formed from loops formed in the basket wrapping material.
Figure 31:
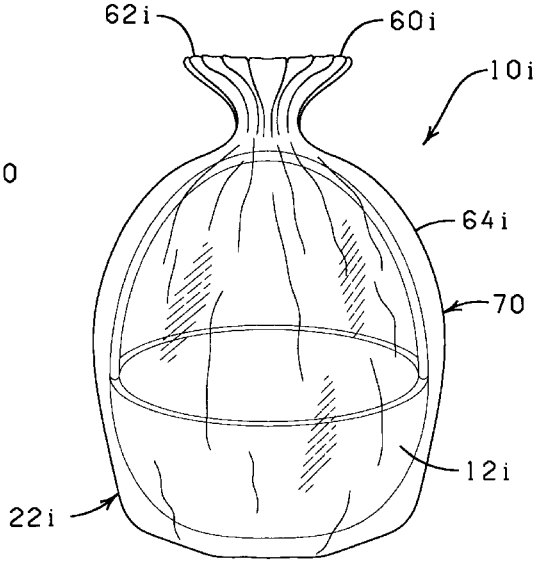
FIG. 31 is a side elevational view of the wrapped basket of FIG. 30, showing the formed bow and closure of the basket wrapping material about the basket.

The Embodiments and Methods of FIGS. 29–31

Disclosed in FIGS. 29–31 is a modified basket wrapping material 10*i* which is identical to the basket material 10 and the sheet of material 22 described previously, except that the sheet of material 22*i* is formed into the shape of a bag 70. The bag 70 has an upper end 72, a closed lower end 74 and an outer peripheral surface 76. An opening 77 is formed in the upper end 72, which forms an inner peripheral surface 78 and a basket retaining space 80. A plurality of bonding material spots 30*i*, similar to those shown previously in FIGS. 17–22 and described above, are disposed on the inner peripheral surface 78 of the bag 70, being disposed about and near the opening 77. It will be understood that the bag 70 has all of the characteristics previously described herein for the basket wrapping material 10 and the sheet of material 22. It will also be appreciated that the bag may form any shape, as long as it functions as described herein.

In a general method of use, as illustrated in FIGS. 29–31, a bag 70 is provided, and a basket 12*i* is disposed therein, in the basket retaining space 80 (not shown). Once the basket 12*i* is disposed in the bag 70, the upper end 72 of the bag 70 is gathered together in the same method shown in FIGS. 17–22 and described in detail above. The plurality of bonding material spots 30*i* are bonded together by the method previously shown and described to form both a bow 60*i* and a closure of the bag 70.

Alternative embodiments, as described previously herein, may also be utilized with the bag 70, as can alternative methods of forming the bow 60*i* and the closure of the bag 70.

Figure 32:
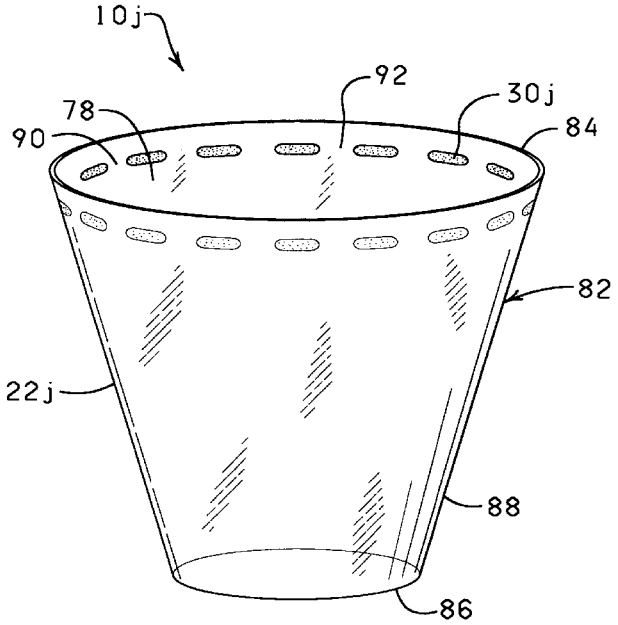
FIG. 32 is a schematic perspective view of another modified basket wrapping material made in accordance with the present invention, showing the sheet of material formed into a sleeve.
Figure 33:
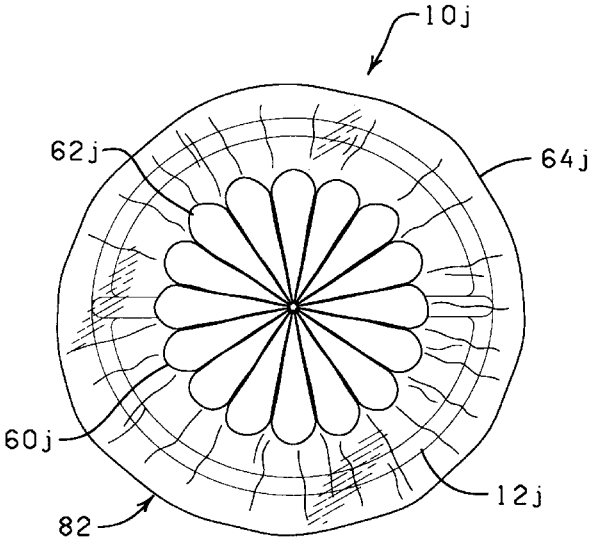
FIG. 33 is a top plan view of a basket wrapped in accordance with the present invention as illustrated in FIG. 32, showing the bow formed from loops formed in the basket wrapping material.
Figure 34:
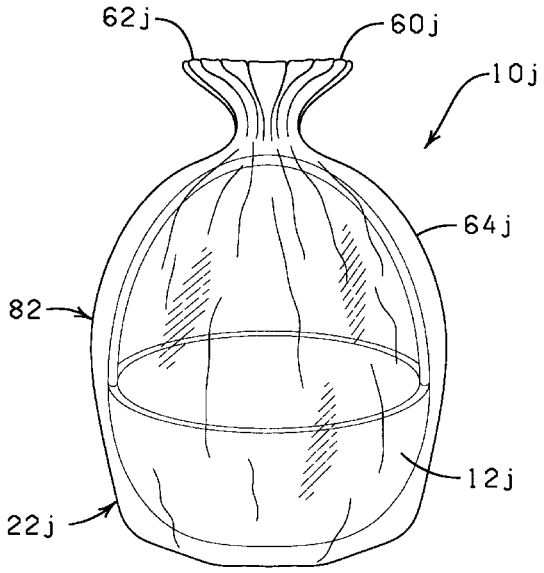
FIG. 34 is a side elevational view of the wrapped basket of FIG. 33, showing the formed bow and closure of the basket wrapping material about the basket.

The Embodiments and Methods of FIGS. 32–34

Disclosed in FIGS. 32–34 is a modified basket wrapping material 10*j* which is identical to the basket material 10 and the sheet of material 22 described previously, except that the sheet of material 22*j* is formed into the shape of a sleeve 82. The sleeve 82 has an upper end 84, a lower end 86 and an outer peripheral surface 88. An opening 90 is formed in the upper end 84 and extends through the lower end 86, which forms an inner peripheral surface 92 and a basket retaining space 94. It will be appreciated that the lower end 86 of the sleeve 82 may also be left closed (not shown), or may be closed before or after a basket 12*j* is disposed in the basket retaining space 94 (not shown).

A plurality of bonding material spots 30*j* are disposed on the inner peripheral surface 88 of the sleeve 82 about and near the opening 90. These plurality of bonding material spots 30*i* may be disposed in any manner as described above, but for purposes of this embodiment, are shown as identical to the plurality of bonding material spots shown in FIGS. 17–22 and described in detail above.

It will be understood that the sleeve 82 has all of the characteristics previously described herein for the basket wrapping material 10 and the sheet of material 22. It will be understood that the sleeve 82 may be formed from one sheet of material 22*j* wrapped in a cylindrical, frusto-conical or reverse frusto-conical shape, the sheet of material 22*j* connecting to itself. Alternatively, it will be appreciated that any sleeve 82 shown and/or described herein may form any shape as long as the sleeve 82 functions as described herein.

In one alternative, the sleeve 82 may be formed from a first sheet of material 22*j* and a second sheet of material 22*jj* (not shown). In this alternative embodiment, the second sheet of material 22*jj* is disposed upon and aligned with the first sheet of material 22*j*. Then the first sheet of material 22*j* and the second sheet of material 22*jj* are connected together to form a sleeve 82, by connecting, for example but not by way of limitation, the first side 40*j* of the first sheet of material 22*j* with the first side 40*jj* of the second sheet of material 22*jj*, and by connecting the second side 42*j* of the first sheet of material 22*j* with the second side 42*jj* of the second sheet of material, said connection made by the bonding material described herein, by heat sealing, by lacquer, or by any other method known in the art.

In a general method of use, as illustrated in FIGS. 32–34, a sleeve 82 and a basket 12*j* are provided. The basket 12*j* is disposed in the basket retaining space 94 of the sleeve 82 (not shown). It will be understood that a portion of the sleeve 82 is of a smaller diameter than the outer surface 18*j* of the basket 12*j*, so that the basket 12*j* is frictionally held within the basket retaining space 94 of the sleeve 82. Once the basket 12*j* is disposed in the basket retaining space 94 of the sleeve 82, the upper end 84 of the sleeve 82 is gathered together in the same method shown in FIGS. 17–22 and described in detail above. The plurality of bonding material spots 30*j* are bonded together by the method previously shown and described to form both a bow 60*j* and a closure of the bag upper end 84 of the sleeve 82.

Alternative embodiments, as described previously herein, may also be utilized with the sleeve 82, as can alternative methods of forming the bow 60*j* and the closure of the sleeve 82. It will be appreciated that additional closure means, such as bonding material or other closure means previously described herein, may optionally be added to any of the above described embodiments to assist in closure of the wrapping.

Changes may be made in the embodiments of the invention described herein, or in parts or elements of the embodiments described herein, or in the sequence of steps of the methods described herein without departing from the spirit and/or scope of the invention as defined in the following claims.

What is claimed is:

1. A decorative basket assembly, comprising:

a basket having an upper end, a lower end, and an outer surface, a basket opening being formed in the basket with a portion of the basket opening intersecting the upper end of the basket forming an inner surface, the basket being sized and shaped for receiving items and the items being retained in the basket; and a basket wrapping material disposed about the outer surface of the basket such that a portion of the basket wrapping material forms a plurality of adhesively connected open loops of substantially equal size which cooperate to form a bow for the decorative basket assembly, the basket wrapping material comprising a sheet of material having an upper surface, a lower surface, an outer periphery and a plurality of spatially disposed bonding materials disposed on at least one surface of the sheet of material whereby, when adjacently spatially disposed bonding materials are brought into bonding engagement, connected open loops of substantially equal size are formed in portions of the sheet of material which cooperate to form the bow of the decorative basket assembly.

2. The decorative basket assembly of claim 1 wherein the sheet of material is fabricated from a material selected from the group consisting of polymer film, fabric, cloth, fiber, paper, burlap, foil or combinations thereof.

3. The decorative basket assembly of claim 1 wherein the sheet of material has a thickness in a range of from about 0.2 mils to about 10 mils.

4. The decorative basket assembly of claim 1 wherein the sheet of material has a thickness in a range of from about 0.5 mils to about 3.5 mils.

5. The decorative basket assembly of claim 1 wherein the plurality of bonding materials disposed on at least one surface of the sheet of material comprises a plurality of adhesive bonding material spots extending near the outer periphery of the sheet of material.

6. The decorative basket assembly of claim 1 wherein the plurality of bonding materials disposed on at least one surface of the sheet of material comprises a plurality of cohesive adhesive bonding material spots extending near the outer periphery of the sheet of material.

7. The decorative basket assembly of claim 1 wherein the sheet of material further comprises a bag.

8. The decorative basket assembly of claim 1 wherein the sheet of material further comprises a sleeve.

9. A method for wrapping a basket, comprising:

providing a basket having an upper end, a lower end and an outer surface, a basket opening being formed in the basket with a portion of the basket opening intersecting the upper end of the basket forming an inner surface, the basket being sized and shaped for receiving items and the items being retained in the basket;

providing a sheet of flexible material having an upper surface, a lower surface, an outer periphery and a plurality of spatially disposed bonding materials disposed on at least one surface of the sheet of material; and wrapping the sheet of flexible material about the outer periphery of the basket whereby adjacently spatially disposed bonding materials are brought into bonding engagement to form connected open loops of substantially equal size which cooperate to form a bow in the sheet of flexible material wrapped about the basket.

10. The method of claim 9 wherein, in the step of providing a sheet of flexible material, the sheet of flexible material is a material selected from the group consisting of polymer film, fabric, cloth, fiber, paper, burlap, foil or combinations thereof.

11. The method of claim 9 wherein, in the step of providing a sheet of flexible material, the sheet of flexible material has a thickness in a range of from about 0.2 mils to about 10 mils.

12. The method of claim 9 wherein, in the step of providing a sheet of flexible material, the sheet of flexible material has a thickness in a range of from about 0.5 mils to about 3.5 mils.

13. The method of claim 9 wherein, in the step of providing a sheet of flexible material, the bonding material comprises a plurality of adhesive bonding material spots extending near the outer periphery of the sheet of flexible material.

14. The method of claim 9 wherein, in the step of providing a sheet of flexible material, the bonding material comprises a plurality of cohesive adhesive bonding material spots extending near the outer periphery of the sheet of flexible material.

15. The method of claim 9 wherein in the step of providing a basket wrapping material, the sheet of material further comprises a bag.

16. The method of claim 9 wherein in the step of providing a basket wrapping material, the sheet of material further comprises a sleeve.

17. A decorative cover for an object, comprising:

a sheet of material wrappable about the object, the sheet of material having an upper surface, a lower surface, an outer periphery and a plurality of spatially disposed bonding material spots disposed on at least one surface of the sheet of material whereby, when adjacently spatially disposed bonding material spots are brought into bonding engagement, connected open loops of substantially equal size are formed in portions of the sheet of material which cooperate to form a bow for the decorative cover.

18. The decorative cover of claim 17 wherein the sheet of material further comprises a bag.

19. The decorative cover of claim 17 wherein the sheet of material further comprises a sleeve.

* * * * *